United States Patent [19]

Wolf

[11] Patent Number: 4,474,539

[45] Date of Patent: Oct. 2, 1984

[54] DUAL PRESSURE GAS COMPRESSOR

[76] Inventor: Raymond J. Wolf, 83135 Rattlesnake Rd., Dexter, Oreg. 97431

[21] Appl. No.: 403,053

[22] Filed: Jul. 29, 1982

[51] Int. Cl.³ ..... F04B 23/04

[52] U.S. Cl. ..... 417/62

[58] Field of Search ..... 417/62, 44, 350; 137/566, 567, 255

[56] References Cited

U.S. PATENT DOCUMENTS

| | | | |
|---|---|---|---|
| 868,718 | 10/1907 | Smith | 417/62 |
| 1,049,894 | 1/1913 | Merrill | 417/62 |
| 2,206,215 | 7/1940 | Allison et al. | 417/62 |
| 2,391,486 | 12/1945 | Smith | 417/62 X |

*Primary Examiner*—Edward K. Look

*Attorney, Agent, or Firm*—Frank D. Gilliam

[57] ABSTRACT

A dual gas compressor configured to operate selectively in either a parallel mode wherein an increased volume of low pressure compressed gas is obtained or in a series mode wherein low pressure and high pressure gases are obtained. The compressed gases exit both compressors upon generation to a remotely positioned storage container or containers for cooling. Selectively operable valve control communication through interconnecting conduits to allow both compressors to generate low pressure gases or allow one compressor to supply low pressure gas to the input of the second compressor to generate high pressure gas. The valves are preferably electric or air pressure operated.

4 Claims, 2 Drawing Figures

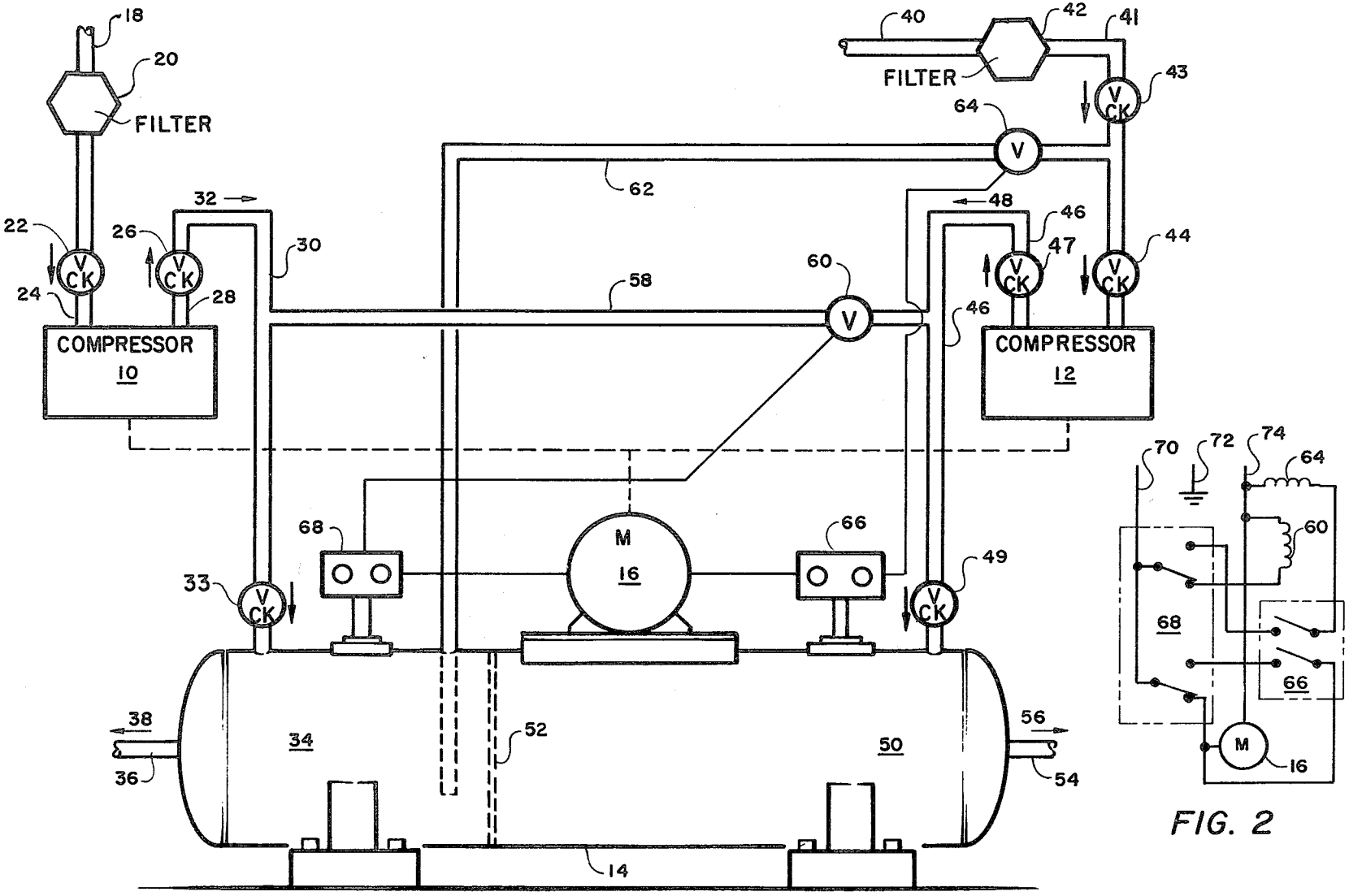
COMPRESSOR 12
COMPRESSOR 10
FILTER
FILTER
M
16
M
16
V
CK
V
CK
V
CK
V
CK
V
CK
V
CK
V
V
V

DUAL PRESSURE GAS COMPRESSOR

BACKGROUND OF THE INVENTION

This invention relates broadly to the control and operation of dual gas compressors and more particularly to dual gas compressing apparatus wherein the gas compressors can be selectively operated in either a dual parallel mode for producing gas at a single pressure level or in a series mode for producing gas at two separate pressure levels.

In U.S. Pat. No. 2,576,876 issued on Nov. 27, 1951, to inventor H. R. Gamble, there is taught a dual stage compressor which can be operated either as a parallel single low pressure compressor or as a series single high pressure compressor. The changes required to convert from one operation to the other is time consuming and requires a bleed down of air pressures and mechanical changes to the device. This teaching does not include a simultaneous production and storage of two separate pressure levels of compressed gas nor does it teach when in the series configuration reducing the heat of compression by conducting the hot compressed gas from the first compression stage to a remote location for cooling of the gas and as an aid to maintain a cool compressor.

The U.S. Pat. No. 2,765,976 issued Oct. 9, 1956 to inventor W. A. Steward teaches only a series two stage compressor with one level of compressed gas pressure.

U.S. Pat. No. 3,031,131 issued Apr. 24, 1962, to inventor E. J. Hilderbrandt, like the last referenced patents, teaches a two stage series compressor with only one level of available compressed gas pressure.

U.S. Pat. No. 3,476,485 issued Nov. 4, 1969, to inventor F. K. Kimderman, teaches a series three stage compressor with only one level of available compressed gas.

U.S. Pat. No. 3,001,692 and 3,574,474 are directed to multi-stage gas compression and methods of control respectively.

There has not been a low cost gas compressing system which is selectable to produce a large volume of compressed gas at low pressure or a smaller volume of low pressure gas and high pressure gas simultaneously until the emergence of the instant invention.

SUMMARY OF THE INVENTION

In accordance with the preferred embodiment of this invention, a dual gas compression machine is provided which is selectively operable either as a single stage compressor, a two stage compressor or as a combined single and two stage compressor. By means of air pressure operated, electric solonoid switches or the like, a single stage compression of gas is accomplished by the two compressors employed and the compressed gas is stored in both compartments of a two compartment storage tank or a dual stage compression of gas is accomplished wherein the low pressure stored gas is stored in one compartment of the two compartment storage tank and the high pressure stage receives low pressure gas input from the storage tank and the high pressure gas is stored in the other storage compartment of the same tank. After the two pressure levels of gas are stored either pressure level is available for external use.

An objeect of this invention is to provide a selectively changeable two stage compressor for use as a single stage compressor, as a high pressure compressor or the combination thereof.

Another object of this invention is to provide automatic operation of the compressors to supply low and high pressure gas and high volume low pressure gas.

Another object of this invention is to eliminate the need for oversizing a compressor to provide both low pressure high volume compressed gas and additional high pressure compressed gas.

Another object of this invention is to utilize the low pressure receiver to act as a cooler for the first stage of compressed gas prior to its entry into the second stage compressor.

Still another object of this invention is to provide a more uniform flow of gas to the second stage compressor due to the supply coming from a receiver rather than directly from the first stage compressor.

These and other objects, which will become apparent upon reading the following descriptions and the following drawing in which:

BRIEF DESCRIPTION OF THE DRAWINGS

FIG. 1 depicts a diagrametric showing of the various components annd their interconnection directed to the instant invention; and FIG. 2 depicts a wiring diagram for the electrical components of the invention.

DETAILED DESCRIPTION OF THE PREFERRED EMBODIMENT

The first embodiment of the instant invention illustrated in FIG. 1 includes two gas compressors 10 and 12 respectively, a two compartment tank 14, a motor 16 for operating the two gas compressors 10 and 12, interconnection conduit and valving means hereinafter identified and discussed in more specific detail.

The compressor 10 receives its gas input through intake 18. This gas if filtered by filter element 20 consisting of any known and respected filter employed in this art. The incoming filtered gas passses through check valve 22 into the compressor input 24. This check valve like the other check valves hereinafter mentioned consist of one way valves well known in the fluid handling art which are open to fluids moving in one direction and closed to fluids moving in the opposite direction. The pressure differentials of the various mentioned check valves are selected for the expected pressure differentials in a known manner. The now pressurized gas leaves compressor 10 through a check valve 26 out exit 28 of the compressor 10. The pressurized gas leaving compressor 10 is directed through check valve 26, conduit 30 in the direction of arrow 32 and through check valve 33 to compartment 34 of gas storage tank 14. Low pressure from compartment 34 exits externally on demand through conduit 36 along arrow 38. It should be understood that although a single tank 14 is shown having two separate compartments, two separate tanks could be successfully utilized to practice this invention.

Intake 40 allows gas to enter through a filter 42 which is the same as filter 20, along conduit 41 through series check valves 43 and 44 into the low pressure input of the compressor 12. The compressed gas exits compressor 12 through conduit 46 along the direction of arrow 48 through check valves 47 and 49 into compartment 50 of storage tank 14. Wall 52 shown in phantom separates compartment 34 from compartment 50. Compressed gas from compartment 50 exits through conduit 54 in the direction of arrow 56 on demand.

Conduit 58 which includes a series valve 60 interconnects conduits 30 and 46. A conduit 62 which includes a series valve 64 interconnects the low pressure compartment 34 of pressure tank 14 to the input of compressor 12 intermediate check valves 43, 44. The valves 60, 64 may be manually operated, but are preferably electrically operated as shown with internal bias to return the valve to a predetermined position when voltage is removed from its activating winding. A gas pressure switch 66 remotely operates the valve 64 and gas pressure switch 68 remotely operates valve 60.

Referring now to the wiring diagram of FIG. 2, switch 68 is a double throw double pole type, switch 66 is a single throw double pole switch and solenoid valves 60 and 64 include an electrical coil. Electrical line 70 supplies voltage, and electrical line 72 is a system ground line and line 74 is AC neutral. The motor 16 is a conventional type AC motor the size of which is chosen to accomodate the selected size of the compressors 10 and 12.

OPERATION OF THE PREFERRED EMBODIMENT

The operation of the system is as follows:

When the pressure of the gas in compartment 34 of tank 14 drops, the low pressure switch 68 closes energizing the motor 16, opens solenoid valve 60 and removes the source of power to the high pressure switch 66 and hence valve 64 remains closed by internal bias means. After the pressure in compartment 34 reaches a predetermined level, switch 68 again opens de-energizing solenoid valve 60, allowing it to close by internal bias means and the source of power is again connected to high pressure switch 66. If at this point in time the high pressure switch 66 has closed due to reduced gas pressure level in compartment 50 of tank 14, the motor 16 is again energized and solenoid valve 64 is opened to gas flow from line 62 into the input of compressor 12. The dual compressor will continue in this high pressure gas compression mode until either the pre-selected level of high pressure is achieved and the high pressure switch 66 opens removing voltage from the motor and solenoid valve 64 which causes the valve 64 to close due to internal biasing shutting off the gas flow from line 62 to the compressor 12 or until the low pressure switch 68 closes due to pressure change in compartment 34.

It can be readily understood that the high pressure switch 66 will control and maintain gas pressure in the high pressure compartment at its pre-determined level as long as the low pressure switch 68 is in an unactivated or open condition. It is also apparent and necessary that the low pressure switch 68 will periodically close to maintain the pressure level of low pressure gas in compartment 34.

While I have described and illustrated a preferred embodiment of my invention, it will be understood that the invention is not limited thereto but may be otherwise embodied within the scope of the following claims.

What is claimed is:

1. An improved motor driven dual gas compressor having selective series or parallel operation comprising:

a first and second compressor means having gas intake means;

a first and second pressurized gas storage means for separately storing compressed gases from each of said compressor means;

interconnecting conduit means interconnecting said first and second compressor means respectively to said first and second pressurized gas storage means, interconnecting the discharge of said second compressor means with said first pressurized gas storage means and interconnecting the first pressurized gas storage means to the input of said second compressor means;

conduit means extending external of said first and second pressurized gas storage means for compressed gas delivery; and first and second valve means, said first valve means associated with the conduit means interconnecting the discharge of said second compressor means with said first pressurized gas storage means and said second valve means associated with the conduit means interconnecting the first pressurized gas storage means to the input of said second compressor means, whereby when said first valve means is open allowing communication through its associated conduit means and said second valve means is closed prohibiting communication through its associated conduit means said first and second compressor means is in a dual compressor configuration for producing a large quantity of low pressure gas and when said first valve means is closed and said second valve means is open said first and second compressor means is in its series compressor configuration for producing high pressure gas.

2. The invention as defined in claim 1 wherein check valves are utilized to prevent gas flow in the reverse of its normal required flow direction.

3. The invention as defined in claim 1 wherein said first and second valve means are electrically operable from a normally biased closed position to an open position.

4. The invention as defined in claim 2 wherein said check valves are positioned in series with the input and output of both of said compressor means, between the intake to said second compressor and the conduit means from the first pressurized gas storage means and at the inputs of said first and second pressurized gas storage means.

* * * * *